US008286708B2

(12) United States Patent
Assal et al.

(10) Patent No.: US 8,286,708 B2
(45) Date of Patent: Oct. 16, 2012

(54) METHODS AND APPARATUSES FOR INSTALLING LATERAL WELLS

(75) Inventors: Anwar Ahmed Maher Assal, Sugar Land, TX (US); Timothy M. O'Rourke, Manila (PH); Jeremie C. Fould, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 298 days.

(21) Appl. No.: 12/469,400

(22) Filed: May 20, 2009

(65) Prior Publication Data

US 2010/0294512 A1 Nov. 25, 2010

(51) Int. Cl.
*E21B 43/00* (2006.01)
*E21B 7/08* (2006.01)
*E21B 47/00* (2012.01)

(52) U.S. Cl. ..... 166/313; 166/50; 166/117.6; 166/255.3

(58) Field of Classification Search ..... 166/313, 166/381, 387, 50, 117.6, 255.3
See application file for complete search history.

(56) References Cited

U.S. PATENT DOCUMENTS 5,443,129 A 8/1995 Bailey et al.
5,467,819 A 11/1995 Braddick
5,474,131 A 12/1995 Jordan, Jr. et al.
5,564,503 A * 10/1996 Longbottom et al. ..... 166/313
6,019,173 A 2/2000 Saurer et al.
6,283,208 B1 9/2001 George et al.
6,419,021 B1 7/2002 George et al.
6,454,007 B1 9/2002 Bailey
6,554,076 B2 4/2003 Guillory et al.
6,619,400 B2 9/2003 Brunet
6,761,217 B1 7/2004 McGarian
7,487,835 B2 * 2/2009 Carter et al. ..... 166/298
7,575,050 B2 * 8/2009 Dale et al. ..... 166/117.6
2002/0070018 A1 6/2002 Buyaert
2002/0162656 A1 * 11/2002 Dewey ..... 166/117.5
2007/0034409 A1 * 2/2007 Dale et al. ..... 175/61
2009/0272547 A1 * 11/2009 Dale et al. ..... 166/387
2010/0294512 A1 * 11/2010 Assal et al. ..... 166/384

OTHER PUBLICATIONS

International Application No. PCT/US2010/035327 filed May 18, 2010 Search Report and Written Opinion with a completed date of Jul. 9, 2010.

* cited by examiner

*Primary Examiner* — Jennifer H Gay
(74) *Attorney, Agent, or Firm* — Rodney Warfford; Tim Curington; William Ryann

(57) ABSTRACT

Methods and apparatuses for installing lateral wells in an underground. The methods and apparatuses allow for efficiency in a milling and installation process for the lateral well. More specifically, tools and techniques are detailed which allow for controllably guided installation of a whipstock and/or subsequent production deflector hardware at locations adjacent lateral legs of a well to allow for such enhanced milling, installation and production efficiencies.

19 Claims, 9 Drawing Sheets

METHODS AND APPARATUSES FOR INSTALLING LATERAL WELLS

BACKGROUND

In the oilfield industry, it is common to install wells that extend laterally from a primary (sometimes vertical) well. These lateral wells extend into the underground formation surrounding the primary well and therefore increase the effective drainage area around the primary well.

Several techniques are currently used to drill and complete lateral wells. In cased primary wells, lateral wells are typically drilled through windows provided in the casing. These windows are often milled through the casing after it has been cemented in the primary well. In order to cut a window in the casing, a device that includes a packer and a whipstock is inserted into the primary well. The packer is set at a location that is immediately downhole of the desired location of the window and in such an orientation that the concave face on the whipstock faces the window. Thereafter a milling device is inserted into the primary well and the concave face on the whipstock deflects the milling device laterally towards the casing and thus facilitates milling at the desired location for the window.

SUMMARY

The applicant has found that known methods and apparatuses for setting a packer and whipstock device for milling a window in a casing of a primary well are not as efficient as desirable. For example, according to known methods and apparatuses it can be very difficult to properly orient the rotational position of the whipstock so that the window is milled at the desired location. Also, known whipstocks are difficult to retrieve once the milling operation is complete. In addition, applicant has found that current apparatus and methods for drilling and completing lateral wells require too many steps and specifically too many production runs into the primary well, thus resulting in inefficiency.

The present application derives from the applicant's efforts to provide improved methods and apparatuses for drilling and completing lateral wells. More specifically, the present application derives from efforts to provide more economical and effective methods and apparatuses for setting a packer and whipstock at a desired orientation in a primary well. The application also derives from efforts to provide more economical and effective methods and apparatuses for retrieving the whipstock from the primary well to thereby allow for further completion or production activities.

In one example, a method of installing a lateral well that deviates from a primary well at a predetermined radial location is provided. The method includes the steps of: (a) installing a downhole assembly in the primary well, the downhole assembly comprising (i) a first part of an orienting device comprising one of an orienting profile and an orienting key; (ii) a packer located downhole of the orienting device; (iii) an isolation device located downhole of the packer and forming a seal that prevents fluid flow through the downhole assembly; (iv) a running tool comprising a measuring device, a circulating device, and a second part of the orienting device comprising the other of the orienting profile and the orienting key, wherein operation of the circulating device and isolation device causes the packer to set; (b) operating the measuring device to identify the rotational orientation of the packer; and (c) operating the circulation device to set the packer.

In another example, the method further includes the step of comparing the identified rotational orientation of the packer to the predetermined radial location and then rotating the packer to orient it relative to the predetermined radial location prior to step (c).

In another example, the running tool includes a milling whipstock having a profiled surface and milling assembly configured to mill a section of well casing at the predetermined location. The method can further include the step of running the milling whipstock along a profiled surface on the whipstock and operating the milling device to mill a window in the casing for the lateral well at the predetermined radial location after step (c).

In another example, a second running tool including a production deflector having a through bore is coupled to a third part of the orienting device comprising the other of the orienting profile and the orienting key. The second running tool is inserted into the primary well and moved towards the downhole assembly, and the third part of the orienting device engages the first part of the orienting device to rotate the second running tool into a rotational position wherein a profiled surface of the production deflector faces the window.

In another example, an apparatus for installing a lateral well that deviates from a primary well is provided. The apparatus includes: a downhole assembly comprising (i) a first part of an orienting device comprising one of an orienting profile and an orienting key; (ii) a packer located downhole of the orienting device and adapted to seal an annular space between the downhole assembly and the primary well; (iii) an isolation device located downhole of the packer and forming a seal that prevents fluid flow through the downhole assembly; (iv) a running tool comprising a measuring device, a circulating device configured to provide a supply of fluid to the downhole assembly, and a second part of the orienting device comprising the other of the orienting profile and the orienting key; wherein operation of the circulating device and isolation device causes the packer to set. The measuring device is operable to identify the rotational orientation of the packer relative to the desired milling location of the window. The circulation device is operable to set the packer.

In another example, the running tool includes a milling whipstock having an orienting face and a milling device.

In another example, a second running tool is provided that includes the other of the orienting profile and orienting key and a production deflector having a through bore through which production fluid can flow. When the second running tool is moved towards the packer, the orienting profile and orienting key are engaged and cause the second running tool to rotate into a rotational position wherein the orienting face of the production deflector will direct production equipment into the well of the lateral well.

DETAILED DESCRIPTION

In the present description, certain terms have been used for brevity, clearness, and understanding. No unnecessary limitations are to be implied therefrom beyond the requirement of the prior art because such terms are used for descriptive purposes only and are intended to be broadly construed. The different apparatus and method steps described herein may be used alone or in combination with other apparatus, systems and method steps. It is to be expected that various equivalents, alternatives and modifications are possible within the scope of the appended claims.

As used herein, a primary well is generally shown as vertical, but can extend at any angle relative to the surface and is shown vertically for descriptive purposes only. Likewise, a lateral well is generally shown as horizontal for descriptive purposes only; it may extend at any angle that is different than that of the primary well at the point of deviation from the primary well.

Figure 1:
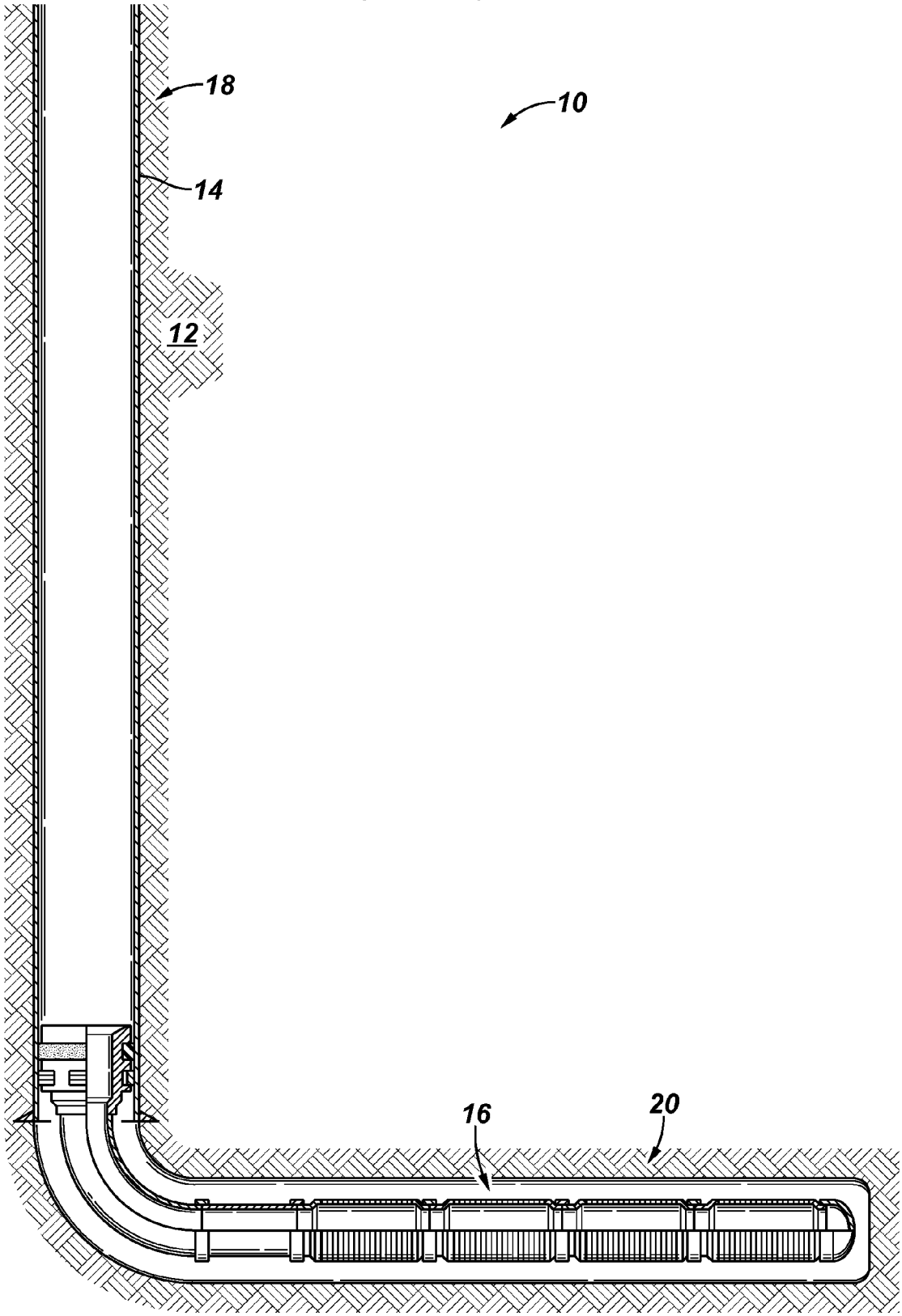
FIG. 1 (Prior Art)
FIG. 1 is a schematic view of a primary well.

FIG. 1 depicts a primary well 10 extending into an underground reservoir 12. The well 10 can be any length and includes a casing 14. A lower completion assembly 16 is disposed in the well 10 for producing and pumping fluids such as hydrocarbons from the surrounding underground reservoir 12 to the surface. The well 10 is shown as having a substantially vertical section 18 and a substantially horizontal section 20 into which the lower completion assembly 16 extends.

Figure 2:
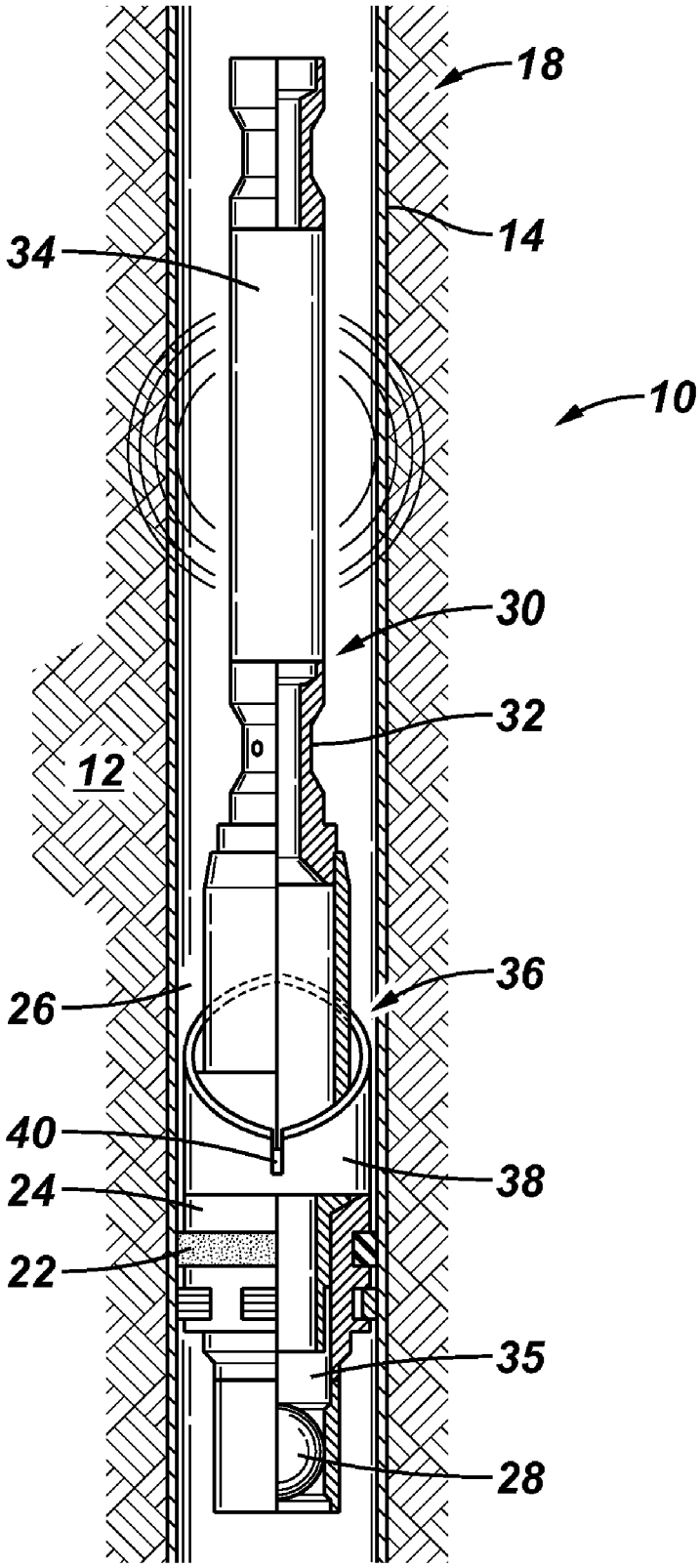
FIG. 2 is a first example showing a schematic view wherein a packer and orienting device and circulation device are run into the primary well.

FIG. 2 depicts apparatus for installing a lateral well that deviates from the primary well 10 above the lower completion assembly 16. The apparatus includes a packer 22 that is attached to the uphole end portion of a base pipe and configured to seal an annular space 26 between the base pipe 24 and the interior surface of the casing 14. The actual configuration of the packer 22 can vary from that shown. Preferably however, the packer 22 is capable of being hydraulically set, such as for example a step bore hydraulic set packer. In the depicted example, an isolation device 28 is located downhole relative to the packer 22 and is configured to form a seal that prevents fluid flow through the interior of the base pipe. In the depicted example, the isolation device 28 comprises a ball valve; however, it is recognized that the isolation device can consist of any one of a number of sealing devices such as a plug, flapper valve, disc, or the like. A first running tool 30 is located uphole of the isolation device 28 and packer 22 and includes a circulating device 32, such as for example an auto fill circulating valve and measuring device 34, such as for example a measurement while drilling (MWD) tool. The purpose and function of these devices will be further described herein below.

An orienting device 36 is disposed in the primary well bore 10 between the packer 22 and the first running tool 30. Preferably, the orienting device 36 includes a first downhole orienting part 38 connected to the uphole end portion of the packer 22 and a second uphole orienting part 40 connected to the downhole end portion of the first running tool 30. The orienting device 36 can be any one of a number of commercially available devices that allow for adjustment of the rotational relationship between the uphole tool (in this case 30) and the downhole equipment (in this case packer 22). This application describes one of the many available options for the orienting device 36.

Figure 3:
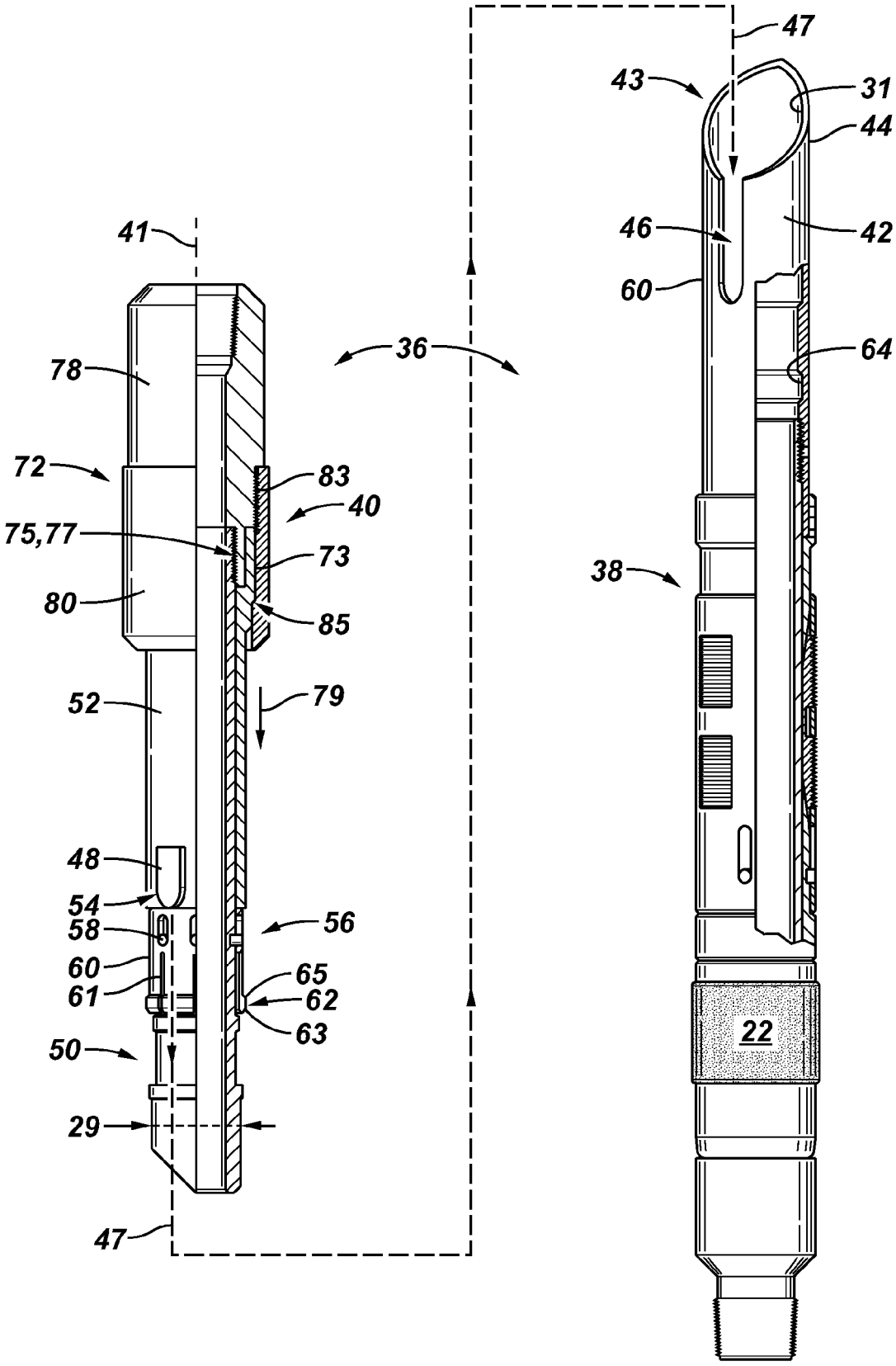
FIG. 3 is a plan view of one example of an orienting device suitable for use in the example shown in FIG. 2.

FIG. 3 depicts the one example of the orienting device 36 in greater detail. In the example shown, the first orienting part 38 is an orienting head 42 that has an open end 43 for receiving the first running tool 30. The orienting head 42 also has a profile surface 44 on its upper end. The profile 44 surface slopes towards a slot 46. The downhole end of the orienting head 42 is connected to the uphole end of the packer 22. The second orienting part 40 of the orienting device 36 includes an orienting key 48 extending outwardly from the downhole end portion of the first running tool 30. The orienting key 48 is sized to engage and slide along the profile surface 44 and to sit in the slot 46 on the orienting head 42 when the first running tool 30 is moved towards the packer 22. A sealing device 50, which in the example shown in FIG. 2 includes sealing rings, creates a seal between the outer circumference 29 (see FIG. 3) of the lower end portion of the first running tool 30 and the inner circumference 31 (see FIG. 3) of the orienting head 42 when the first running tool 30 is inserted into the orienting head 42 and the orienting key 48 seats in the slot 46. A sealed annular space 35 is thus created between the isolation device 28 and the circulating valve 32 when the first orienting part 38 of the orienting device 36 engages the second orienting part 40 of the orienting device 36.

The uphole end portion of the second part 40 of the orienting device 36 is threaded for engagement with a corresponding threaded portion (not shown in FIG. 3) of the first running tool 30. The orienting key 48 extends outwardly from an outer surface of mandrel 52 and includes beveled edges 54 for engaging and sliding along the profile surface 44 of the orienting head 42 on the first part 38 of the orienting device 36. The orienting key 48 has a width that is slightly smaller than the width of the slot 46 in the orienting head 42. As shown schematically in FIG. 3 by arrow 47, when the first part 38 is moved towards the second part 40, the orienting key 48 contacts and slides along the downwardly sloped profile surface 44 and engages in or seats in the slot 46. Movement of the second part 40 towards the first part 38 causes rotational movement of the second part 40 about its longitudinal axis 41 and thus changes the rotational orientation of the second part 40 relative to the first part 38. Once the orienting key 48 is seated in the slot 46, further rotation between the first part 38 and second part 48 is prevented. In the preferred example, the sloped profile surface 44 has a helical shape, which encourages the aforementioned sliding movement of the orienting key 48 into the slot 46 and rotational movement of the second part 40 relative to the first part 38.

The second part 40 of the orienting device 36 also includes a shearable anchor latch 56, which in the example shown includes a plurality of shear screws 58 spaced apart around the outer circumference of the second part 40 and a plurality of locking dogs 60 spaced apart around the outer circumference of the second part 40. Each locking dog 60 has an outwardly extending foot 62 having a lower beveled surface 63 and an upper beveled surface 65. Each locking dog 60 is separated from adjacent dogs in the plurality by a slot 61. In this example, when the second part 40 of the orienting device 36 is moved towards the first part 38 of the orienting device 36, the lower beveled surface 63 of each dog 60 is biased inward when it engages the interior surface of the orienting head 42. The locking dogs 60 thus slide along the interior surface 31 of the orienting head 42 as the orienting key 48 slides along the profile surface 44 toward the slot 46. When the orienting key 48 is seated in the slot 46, the feet 62 of the locking dogs 60 reach an annular collar 64 in the first part 38 of the orienting device 36. The resiliency of the cantilevered dogs 60 causes the feet 62 to spring back into a normal unbiased outwardly extending position, wherein the feet 62 engage the inner concave surface of annular collar 64. In this engaged position, the dogs 60 help prevent longitudinal movement (e.g. removal) of the second part 40 relative to the first part 38. In this example, if a certain predetermined force is applied to pull the second part 40 of the orienting device 36 out of the first part 38 of the orienting device, the shear screws 58 will shear off and thus permit release of the shearable anchor latch 56 and removal of the second part 40 of the orienting device 36 from the first part 38 of the orienting device 36. During removal of the second part 40, the dogs 60 will be biased inwards along the interior surface of the orienting head 42 when the upper beveled surface 65 moves out of the collar 64 and until the feet 62 clear the profile surface 44.

During installation, the running tool 30, orienting device 36, packer 22 and the isolation device 28 are installed in the primary well 10. While running into the primary well 10, the circulating valve 32 is operated (or opened by default) to provide circulation of completion fluid to uphole assembly components, per conventional methods. The circulating valve 32 is operated to fill the annular space 26 and allow for measurement by the measuring device 34. The measuring device 34 is configured to identify the rotational orientation of the packer 22 and/or associated orienting device 36 relative to a desired milling location for a proposed window for a lateral well. For example, the measuring device 34 identifies the location of the slot 46 on the orienting head 42 relative to the desired milling location. This orientation information is communicated to the operator by the measuring device 34 according to conventional methods, such as an electrical communication line or other wired or wireless communication link. Thus, it is possible to operate the measuring device 34 to identify the current orientation of the packer 22 to allow for adjustment of the orientation of the packer 22 to facilitate milling a window in the casing 14. It can also be possible for the operator to adjust the orientation of the packer 22 from the surface so that the orienting profile surface 44 is in a convenient orientation relative to the intended location of the window for the proposed lateral well.

At or after the step of measuring the orientation of the packer 22 (and possibly adjusting the orientation of the profile surface 44), the circulating device 32 is operated to increase the fluid pressure inside the annular space 35 and to thereby cause the packer 22 to hydraulically set against the interior surface of casing 14. This will effectively lock the first part 38 of the orienting device 36 and packer 22 in a particular orientation, which can be identified and logged by the measuring device 34. Because the orientation of the packer 22 is known from the measurements taken by the measuring device 34, and the desired location of a window to be milled in the casing 14 is known, it is possible to set the packer 22 at a known location that will provide for convenient or efficient milling operations, as discussed above. Thereafter, the first running tool 30 can be removed from the primary well 10 by pulling upwardly on the first running tool 30 by a force great enough to shear the screws 58 and allow for separation of the shearable anchor latch 56.

Figure 4:
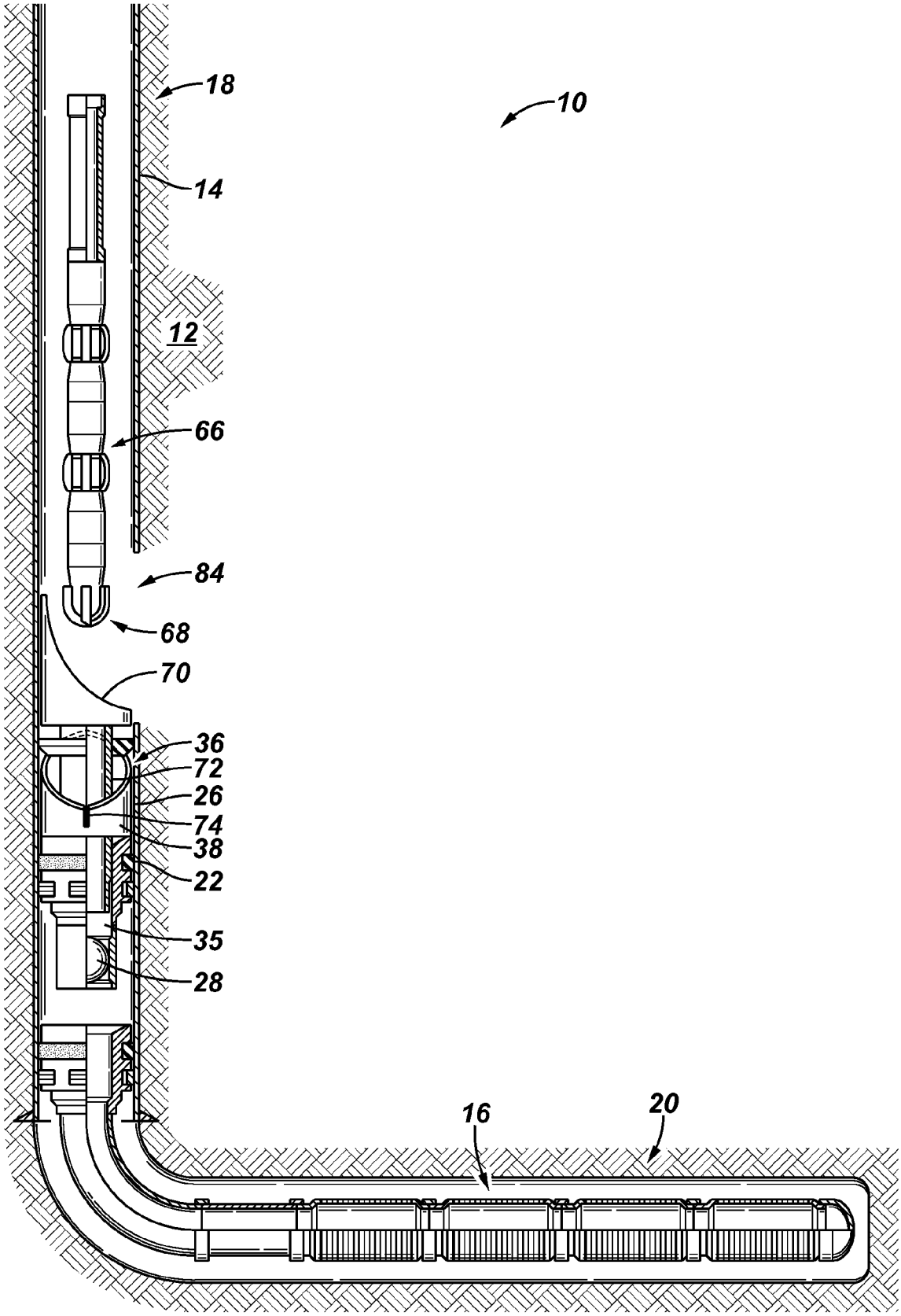
FIG. 4 is a schematic view of a milling whipstock, with a milling device being run into the primary well and aligned to mill a window at a desired location.

FIG. 4 depicts further apparatus for installing the lateral well bore. A second running tool 66 is inserted into the primary well bore 10 and moved towards the packer 22. The second running tool 66 includes a milling device 68, a milling whipstock 70 and a rotatably adjustable device including an indexing mechanism or adjustment device 72 that connects the milling whipstock 70 to a third part 74 of the orienting device 36. In the example shown, the third part 74 of the orienting device 36 including the adjustment device 72 is configured the same as the example depicted for the second part 40 of the orienting device 36.

Figure 5:
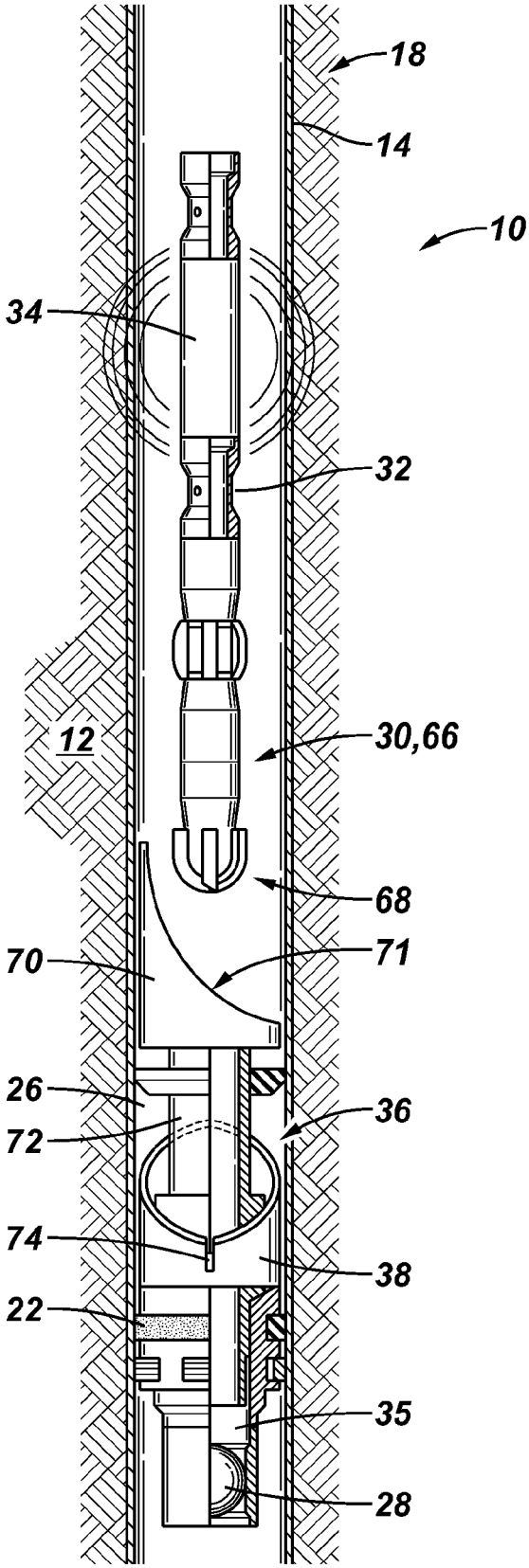
FIG. 5 is a second alternative example wherein a packer, orienting device, circulation device and milling whipstock are run into the primary well.

FIG. 5 depicts another preferred example, wherein the first and second tools 30, 36 are combined and the steps described with reference to FIGS. 2 and 4 above are combined into one step. In this example, the running tool (30, 66), includes the measuring device 34, circulating device 32, milling device 68, milling whipstock 70, rotatably adjustable device including an indexing mechanism or adjustment device 72, and third part 74 of the orienting device 36. The entire assembly, including the aforementioned structures and the first orienting part 38, packer 22, and isolation device 28, are run in hole simultaneously. As the run is made, a circulation device 32 and measuring device 34 are operated, as described above, to determine the orientation of the packer 22 with respect to a desired location for a window in casing 14. In this manner, the number of trips required to orient and set the packer 22, orient the milling whipstock 70 and conduct milling and installation procedures described below are decreased. This enhances efficiency and allows for fewer trips into the well bore.

Because the packer 22 is already set at a known orientation relative to the desired location of a window to be milled in the casing 14, and typically the rotational position of the milling deflector 70 to the third part 74 of the orientation device 36 is known, it is possible to run the second tool 66 into the primary well bore 10 and achieve a desired orientation of the milling whipstock 70 relative to the desired location for a window 84. Alternatively, adjustment of the adjustment device 72 can be made at the surface, as follows.

Referring to FIG. 3, the adjustment device 72 is encased by opposing uphole and downhole cylinders 78, 80 which are mounted concentrically on the uphole portion of the mandrel 52. The downhole cylinder 80 is connected to the uphole cylinder 78 by a threaded connection 83. The adjustment device 72 includes an adjustable spline that includes a series of seventy two interlocking teeth 75 mounted at five degree increments around the outer circumference of the mandrel 52 and a corresponding series of seventy two interlocking teeth 77 mounted around the inner circumference of the uphole cylinder 78 and designed to engage with the teeth 75 on the mandrel 52. To access the adjustment device 72, the downhole cylinder 80 is rotated to the left (relative to the view shown in FIG. 3) and the threaded connection 83 releases to move the downhole cylinder 80 downwardly along the mandrel 52, as shown by arrow 79. The orienting key 48 on the mandrel 52 and the uphole cylinder 78 can then be rotatably oriented relative to each other by interlocking the teeth 75, 77 at a desired five degree increment. Thereafter the downhole cylinder 80 is moved back up the mandrel 52 (i.e. in a direction opposite the direction of arrow 79) and the threaded connection 83 is remade. A stop ring 85 on the uphole cylinder 78 engages a shoulder 87 on the mandrel 52 to hold the uphole cylinder 78 and mandrel 52 together via the threaded connection 83. Operation of the adjustment device 72 thus allows for rotation of the location of uphole portions of the running tool 66, including the milling whipstock 70 relative to the location of the orienting key 48 and fixably positioning the milling whipstock 70 at predetermined rotational intervals relative to the orienting key 48.

Thus, as a contingency, prior to running the second running tool 66 (or 30, 66) into the primary well 10, it is possible to operate the adjustable device 72 to index the rotational orientation of the milling whipstock 70 relative to the third part 74 of the orienting device 36. Preferably, the milling whipstock 70 and third part 74 are rotationally indexed apart from each other at an angle such that when the second running tool 66 is run into the primary well 10, the milling whipstock 70 will be rotated by the orientation device 36 into a position wherein the profiled or curved face 71 of the milling whipstock 70 faces a desired milling location for a window 84 for the proposed lateral well. For example, if it is determined by the measuring device 34 that the slot 46 on the first part 38 of the orienting device 36 is rotated a distance of 30 degrees from the desired window location, the orienting key 48 on the third part 74 of the orienting device 36 can be indexed at a rotational orientation that is 30 degrees apart from the curved surface 71 of the milling whipstock 70. Thus, when the second running tool 66 is inserted into the primary well 10, the key 48 will seat in slot 46 and because the key 48 and the curved face 71 of the milling whipstock 70 are rotationally spaced apart at an angle of 30 degrees, the milling whipstock 70 will automatically rotate 30 degrees away from the slot 46 and thus face the desired milling location for the window 84.

Figure 6:
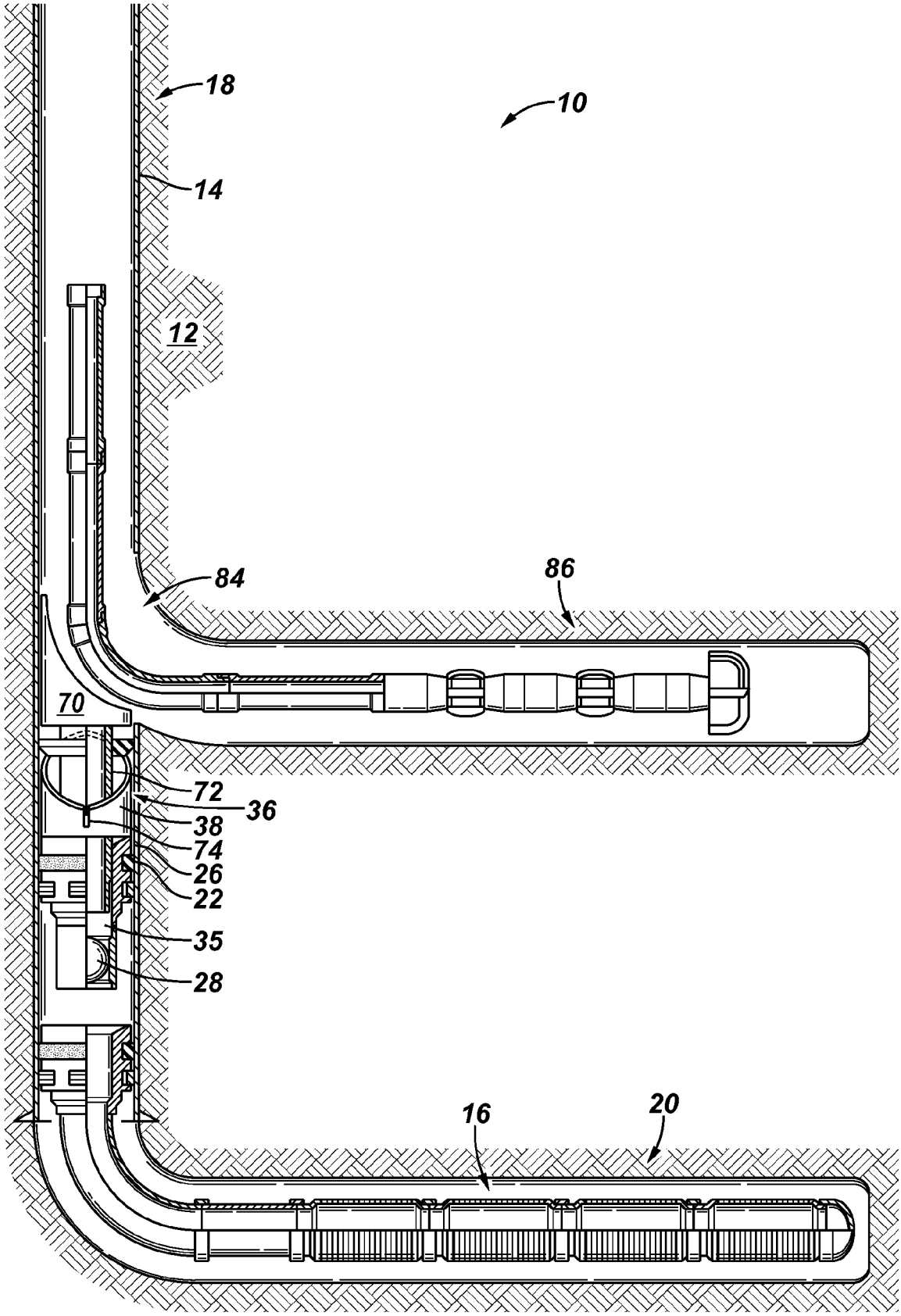
FIG. 6 is a schematic view of a lateral well extending from the primary well.

FIG. 6 shows the primary well 10 after a window 84 has been milled and drilling equipment inserted to drill a lateral well bore 86. The milling device 68 is separated from the second running tool 66 and run downhole along the curved surface 71 towards the casing 14 to mill the window 84 and the further conventional drilling procedures can be entertained.

Figure 7:
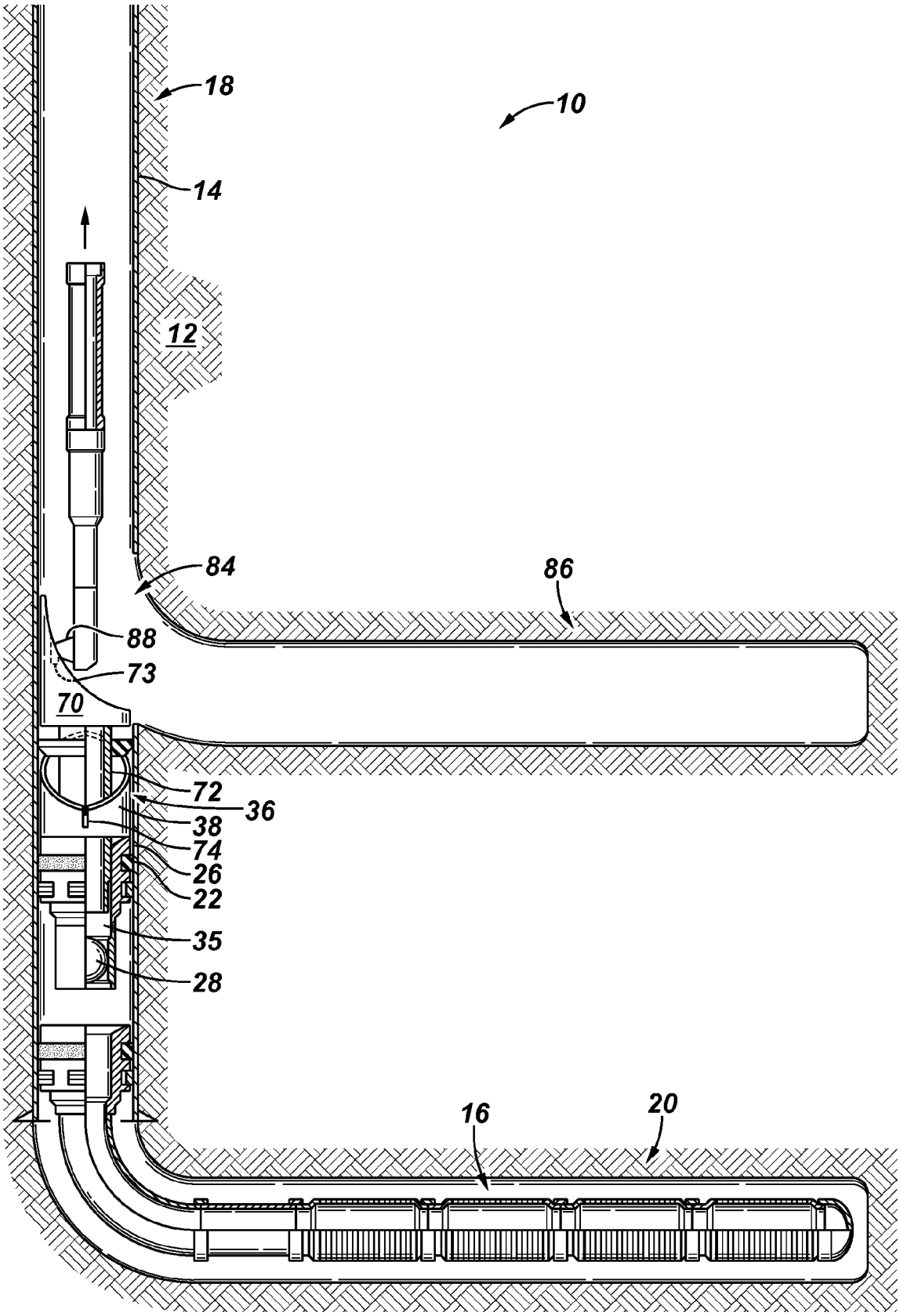
FIG. 7 is a schematic view of a retrieval device for retrieving the milling whipstock from the primary well.

Once milling and drilling procedures for the lateral well bore 86 are complete, the milling device 68 can be removed from the lateral well 86 and primary well 10. Referring to FIG. 7, the milling whipstock 70 includes a slot 73 configured to engage with a retrieval hook 88 to facilitate retrieval of the milling whipstock 70 from the primary well 10. The retrieval hook 88 is inserted into the primary well bore 10 and engaged in the slot 73. An upward force is applied to the retrieval hook 88 that is sufficient to shear the shear screws 58 on the orienting device 36 and thus separate the third part 74 of the orienting device 36 from the first part 38 of the orienting device 36, according to the process described regarding the second part 40. The retrieval hook 88, milling whipstock 70, adjustment device 72 and third part 74 of the orienting device 36 can therefore easily be removed from the primary well 10 by the retrieval hook 88. It will be recognized by those skilled in the art that the example of the retrieval hook 88 is one of many potential configurations for retrieving the milling whipstock 70.

Figure 8:
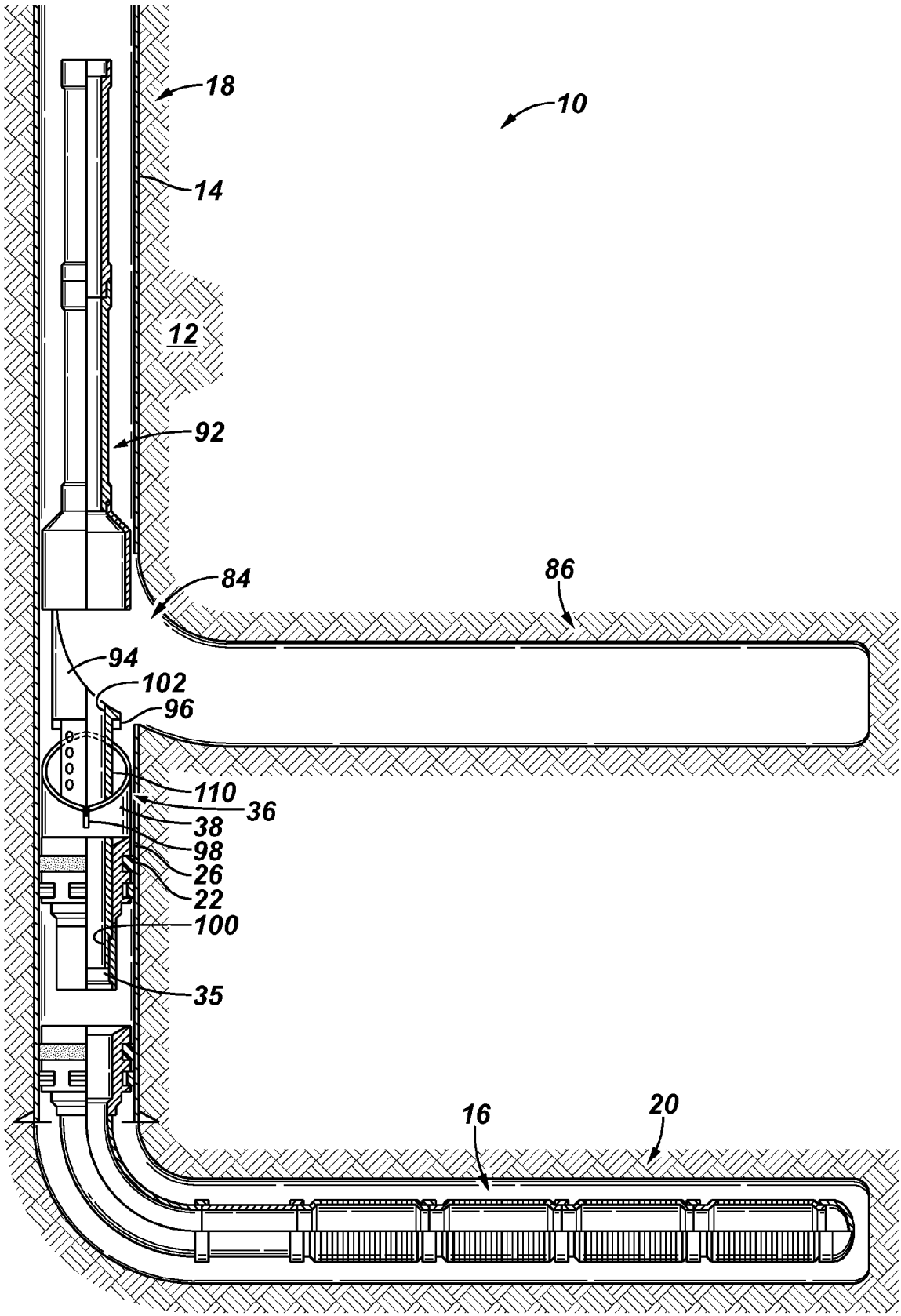
FIG. 8 is a schematic view of an orienting device coupling a production deflector and by pass sub to the packer to open an isolation device.

FIG. 8 depicts additional apparatus for further completing the lateral well 86. A third running tool 92 includes a production deflector 94, a rotatably adjustable device 96 that connects the production deflector 94 to a fourth part 98 of the orienting device 36. In the example shown, the fourth part 98 of the orienting device 36 is configured the same as the second part 40 of the orienting device 36 shown in FIG. 3. The adjustment device 96 can be configured the same as the adjustment device 72 shown in FIG. 3 and facilitates rotation of the production deflector 94 relative to the fourth part 98 of the orienting device 36 and more specifically relative to the orienting key 48, if necessary. Prior to running the third running tool 92 into the primary well 10, the adjustment device 96 can optionally be operated to index the orientation of the production deflector 94 relative to the fourth part 98 of the orienting device 36 to achieve the same offset angle determined to exist between the first part 38 of the orienting device and the window 84. As such, when the third running tool 92 is inserted into the primary well 10, the orienting key 48 on the fourth part 98 engages the profile surface 44 and seats in the slot 46 thereby rotating the third running tool 92 into a predetermined rotational position wherein the production deflector 94 faces the window 84 for the lateral well 86. Further production equipment 102 inserted into the primary well 10 can thus be deflected into the lateral well 86, as shown in FIG. 9.

The third running tool 92 also includes a opening device 100. The opening device 100 is adapted to open the seal formed by the isolation device 28 as the third running tool 92 is coupled to the packer 22 and more specifically as the orienting key 48 is engaged in the slot 46. In the example shown, the opening device 100 may include a conventional device for unseating a ball valve or unsealing a plug or flapper valve. In another example, the opening device 100 can be a shoe that breaks a disc of the isolation device 28, thereby allowing fluid flow through the base pipe 24.

The production deflector 94 includes a through-bore 102 through which production fluid from downhole portions of the primary well 10 can flow towards the surface. Therefore, once the third running tool 92 is fully inserted into the primary well 10 such that the fourth part 98 of the orienting device engages with the first part 38 of the orienting device, production from downhole portions of the primary well 10 and other associated lateral wells can commence. A bypass sub 110 located below the production deflector 94 allows for utilization of the casing ID for production and thereby to limit the small ID most likely created by the production deflector 94. This aspect allows for a small production deflector, while limiting high flow and erosion, and increasing longevity of the well, especially in a sand control scenario.

Figure 9:
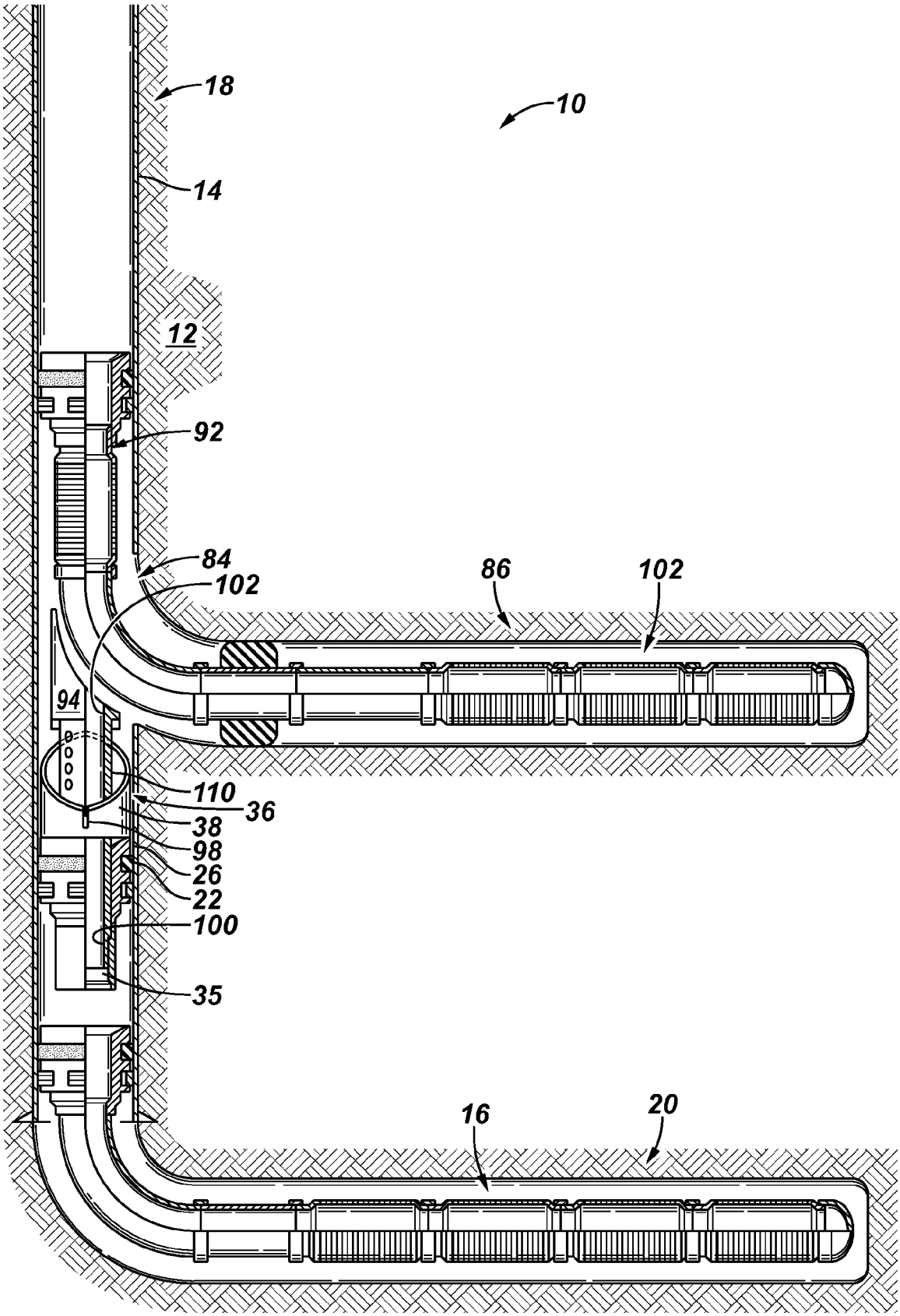
FIG. 9 is a schematic view of production equipment for completing the lateral well.

Once the production deflector is installed, the remainder of third running tool 92 is pulled up and further well completion apparatus 102 inserted into the lateral well bore 86, as shown in FIG. 9.

What is claimed is:

1. A method of installing a lateral well, the lateral well deviating from a primary well at a predetermined radial location, the method comprising the steps of:

(a) installing a downhole assembly in the primary well so as to engage a lower assembly disposed in the primary well, the downhole assembly comprising (i) a first part of an orienting device comprising one of an orienting profile and an orienting key;

(ii) a packer located downhole of the orienting device;

(iii) an isolation device located downhole of the packer and forming a seal that prevents fluid flow therepast and into the downhole assembly;

(iv) a running tool comprising a measuring device, a circulating device, and a second part of the orienting device comprising the other of the orienting profile and the orienting key, wherein operation of the circulating device and isolation device causes the packer to set;

(b) operating the measuring device to identify the rotational orientation of the packer;

(c) operating the circulation device to set the packer;

(d) separating the first and second parts of the orienting device by removing the running tool in an uphole direction away from the downhole assembly;

(e) providing a second running tool, the second running tool comprising a milling device and a milling whipstock connected to a third part of the orienting device comprising the other of the orienting profile and the orienting key;

(f) inserting the second running tool into the primary well, wherein as the second running tool approaches the downhole assembly, the third part of the orienting device engages the first part of the orienting device to rotate the milling whipstock into a desired rotational position wherein a profiled surface on the milling whipstock faces the predetermined radial location;

(g) inserting a retrieving tool into the primary well and using the retrieving tool to remove the milling whipstock from the primary well;

(h) providing a third running tool, the third running tool comprising a production deflector having a through-bore for downhole fluid production therethrough, the production deflector coupled to a fourth part of the orienting device comprising the other of the orienting profile and the orienting key; and (i) inserting the third running tool into the primary well, wherein as the third running tool is moved towards the downhole assembly, the fourth part of the orienting device engages the first part of the orienting device to rotate the third running tool into a rotational position wherein a profiled surface of the production deflector faces the window.

2. The method of claim 1, comprising the step of comparing the identified rotational orientation of packer to the predetermined radial location and then rotating the packer for orientation relative to the predetermined radial location prior to step (c).

3. The method of claim 1, wherein the running tool further comprises a milling whipstock having a profiled surface and milling assembly configured to mill a section of well casing at the predetermined radial location.

4. The method of claim 3, further comprising the step of running the milling whipstock along a profiled surface on the whipstock and operating the milling device to mill a window in the casing for the lateral well at the predetermined radial location after step (c).

5. The method of claim 1, further comprising the step of separating the first and second parts of the orienting device by removing the running tool in an uphole direction away from the downhole assembly after step (c).

6. The method of claim 5, further comprising the step of using a retrieving tool to remove the milling whipstock from the primary well.

7. The method of claim 1, wherein the orienting device comprises a shearable anchor latch that releasably connects the first and second parts of the orienting device.

8. The method of claim 1, further comprising the steps of:

running the milling device along the profiled surface and operating the milling device to mill a window in a well casing for the lateral well at the predetermined radial location.

9. The method of claim 8, comprising the step of adjusting the orientation of the third part of the orienting device relative to the milling whipstock based upon the identified rotational orientation of the packer.

10. The method of claim 9, wherein the orienting device comprises a shearable anchor latch that releasably connects the first and third parts of the orienting device when the second running tool is moved towards the packer and that shears apart when the second running tool is moved away from the packer.

11. The method of claim 1, wherein the third running tool further comprises a rotatably adjustable device that connects the production deflector to the other of the orienting profile and the orienting key and comprising the step of adjusting the orientation of the production deflector relative to the fourth part of the orienting device based upon the identified orientation of the packer.

12. The method of claim 11, wherein the third running tool further comprises an opening device that opens the seal formed by the isolation device as the third running tool moves towards the packer.

13. Apparatus for installing a lateral well that deviates from a primary well, the apparatus comprising:

a downhole assembly having a downhole end configured to engage a lower assembly configured to be disposed within a well and further comprising (i) a first part of an orienting device comprising one of an orienting profile and an orienting key;

(ii) a packer located downhole of the orienting device and adapted to seal an annular space between the downhole assembly and the primary well;

(iii) an isolation device located downhole of the packer and forming a seal that prevents fluid flow therepast and into the downhole assembly;

(iv) a first running tool comprising a measuring device, a circulating device configured to provide a supply of fluid to the downhole assembly, and a second part of the orienting device comprising the other of the orienting profile and the orienting key; wherein operation of the circulating device and isolation device causes the packer to set, wherein the measuring device is operable to identify the rotational orientation of the packer relative to the desired milling location of the window; and wherein the circulation device is configured to cause the packer to set;

(v) a second running tool comprising the other of the orienting profile and the orienting key and a milling whipstock having an orienting face, wherein when the second running tool is moved towards the packer, the second orienting key and orienting profile engage and cause the second running tool to rotate into a rotational position wherein the orienting face of the milling whipstock will direct a milling tool to mill a window of the lateral well at the desired milling location; and (vi) a third running tool comprising the other of the orienting profile and orienting key and a production deflector having a through-bore through which production fluid can flow, wherein when the third running tool is moved towards the packer, the orienting key and orienting profile are engaged and cause the second running tool to rotate into a rotational position wherein the orienting face of the production deflector will direct production equipment into the window of the lateral well.

14. The apparatus of claim 13, wherein the second running tool further comprises a milling whipstock having an orienting face and a milling device.

15. The apparatus of claim 13, wherein the orienting profile comprises a helical surface that guides the orienting key into a slot.

16. The apparatus of claim 13, wherein the orienting profile is part of an orienting head that is coupled to an uphole end portion of the packer and the orienting key is coupled to a downhole end portion of the running tool.

17. The apparatus of claim 13, wherein the running tool comprises an adjustable device that facilitates adjustment of the rotational position of the orienting device relative to the packer.

18. The apparatus of claim 13, wherein the isolation device is selected from the group consisting of a plug, a disc, a flapper valve, and a ball valve.

19. The apparatus of claim 13, further comprising a bypass sub located downhole of the production deflector.

* * * * *